US007920116B2

(12) United States Patent
Woo et al.

(10) Patent No.: US 7,920,116 B2
(45) Date of Patent: Apr. 5, 2011

(54) METHOD AND CIRCUIT OF SELECTIVELY GENERATING GRAY-SCALE VOLTAGE

(75) Inventors: Jae-Hyuck Woo, Gyeonggi-do (KR); Jae-Goo Lee, Gyeonggi-do (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 978 days.

(21) Appl. No.: 11/755,834

(22) Filed: May 31, 2007

(65) Prior Publication Data

US 2008/0043044 A1 Feb. 21, 2008

(30) Foreign Application Priority Data

Jun. 23, 2006 (KR) ..... 10-2006-0056631

(51) Int. Cl.
*G09G 3/36* (2006.01)

(52) U.S. Cl. ..... 345/89; 345/87; 345/100; 345/101; 345/98

(58) Field of Classification Search ..... 345/55, 345/87, 89, 98, 100, 101, 204, 211, 215, 345/690; 348/500, 14.14; 341/118, 144
See application file for complete search history.

(56) References Cited

U.S. PATENT DOCUMENTS

| | | | | |
|---|---|---|---|---|
| 5,489,918 | A * | 2/1996 | Mosier | 345/89 |
| 6,414,664 | B1 * | 7/2002 | Conover et al. | 345/89 |
| 6,950,045 | B2 * | 9/2005 | Kim | 341/118 |
| 7,046,223 | B2 * | 5/2006 | Hashimoto | 345/89 |
| 7,098,901 | B2 * | 8/2006 | Nakano et al. | 345/204 |
| 2002/0093475 | A1 * | 7/2002 | Hashimoto | 345/87 |
| 2002/0158859 | A1 * | 10/2002 | Nakano et al. | 345/204 |
| 2004/0075674 | A1 * | 4/2004 | Bu | 345/690 |
| 2005/0012813 | A1 * | 1/2005 | Wu | 348/14.14 |
| 2005/0122321 | A1 * | 6/2005 | Akai et al. | 345/204 |
| 2006/0208982 | A1 * | 9/2006 | Hashimoto | 345/88 |
| 2007/0018919 | A1 * | 1/2007 | Zavracky et al. | 345/87 |

FOREIGN PATENT DOCUMENTS

| | | | |
|---|---|---|---|
| JP | 06-175620 | | 6/1994 |
| JP | 08-022266 | | 1/1996 |
| JP | 2002-333863 | | 11/2002 |
| JP | 2003066410 | | 3/2003 |
| KR | 1020050003233 | A | 1/2005 |
| KR | 1020050054447 | A | 6/2005 |

* cited by examiner

*Primary Examiner* — Prabodh M Dharia
(74) *Attorney, Agent, or Firm* — Volentine & Whitt, PLLC

(57) ABSTRACT

Embodiments of the present invention provide a method for driving a liquid crystal display (LCD) device using gray-scale voltages whose dynamic ranges are different from each other depending on pixel color. The gray-scale voltages are output to a source line driver. Embodiments of the invention also provide a gray-scale voltage generation circuit coupled to a LCD source line driver. The disclosed method and circuit reduce coupling phenomena in source lines to substantially remove artifacts such as stripes or flicker in an LCD device.

16 Claims, 8 Drawing Sheets

METHOD AND CIRCUIT OF SELECTIVELY GENERATING GRAY-SCALE VOLTAGE

CROSS-REFERENCE TO RELATED APPLICATIONS

This application claims priority under 35 USC §119 to Korean Patent Application No. 10-2006-0056631, filed on Jun. 23, 2006 in the Korean Intellectual Property Office (KIPO), the disclosure of which is incorporated herein in its entirety by reference.

BACKGROUND OF THE INVENTION

1. Field of the Invention

The present invention relates to a liquid crystal display (LCD) device, and more particularly, but not by way of limitation, to a method and a circuit for applying gray-scale voltages with differing dynamic ranges to a source line driver in a LCD panel.

2. Description of the Related Art

Generally, an LCD driver includes a gate driver for driving gate lines (or row lines) and a source driver for driving source lines (or column lines) to drive an LCD panel. The gate driver applies a high voltage to an LCD device, and thereby thin film transistors are turned on, and then the source driver applies source drive signals for indicating pixel colors to the source lines, respectively and thereby an image is displayed on the LCD device.

FIG. 1 is a block diagram illustrating a conventional LCD device having a multi-channel single-amplifier structure.

Referring to FIG. 1, the LCD device includes a memory 100 storing display data, a source line driver 200 having a multi-channel single-amplifier structure, and an LCD panel 300 on which a plurality of pixels R1, G1, B1, R2, G2 and B2 are arranged. RGB signals are represented such that a red signal is r, a green signal is g, and a blue signal is b.

The source line driver 200 includes a multiplexer 210, a decoding unit 220, an amplification unit 230, and a demultiplexer 240. The multiplexer 210 multiplexes display data transmitted from the memory 100 in response to first control signals Dr, Dg and Db, and then transmits the multiplexed display data to the decoding unit 220. The multiplexer 210 consists of first switches 211, 212, 213, 214, 215 and 216 which are turned on/off in response to the first control signals Dr, Dg and Db.

The decoding unit 220 decodes output levels of the display data in response to a gray level. The decoded signals are amplified by the amplification unit 230 and then transmitted to the demultiplexer 240.

The demultiplexer 240 provides the amplified signals transmitted from the amplification unit 230 to source lines S_r1, S_g1, S_b1, S_r2, S_g2 and S_b2 in response to second control signals Tr, Tg and Tb. The demultiplexer 240 consists of second switches 241, 242, 243, 244, 245 and 246 which are turned on/off in response to the second control signals Tr, Tg and Tb.

One amplifier AMP1 of the amplification unit 230 is connected to three source lines S_r1, S_g1 and S_b1. That is, the source line driver 200 has a 3-channel per amplifier structure in which a single amplifier drives three source lines.

FIG. 2 is a timing diagram for signals in a source driver having the 3-channel per amplifier structure illustrated in FIG. 1.

Referring to FIG. 2, the control signals Dr, Dg and Db are sequentially enabled while a gate line Gi of pixels R1, G1, B1, R2, G2 and B2 is enabled. When the signal Dr is enabled, video signals transferred through the first switches 211 and 214 are transmitted to the demultiplexer 240 via decoders 221 and 222 and amplifiers 231 and 232. When the signal Dg is enabled, video signals transferred through the first switches 212 and 215 are transmitted to the demultiplexer 240 via the decoders 221 and 222 and the amplifiers 231 and 232. When the signal Db is enabled, video signals transferred through the first switches 213 and 216 are transmitted to the demultiplexer 240 via the decoders 221 and 222 and the amplifiers 231 and 232.

Signals Tr, Tg and Tb are sequentially enabled and then the gate line Gi is disabled. When the signal Tr is enabled, signals respectively amplified by the amplifiers 231 and 232 are transmitted to the source lines S_r1 and S_r2 through the second switches 241 and 244, respectively. When the signal Tr is disabled, the source lines S_r1 and S_r2 are floated.

When the signal Tg is enabled, the signals respectively amplified by the amplifiers 231 and 232 are transmitted to the source lines S_g1 and S_g2 through the second switches 242 and 245, respectively. When the signal Tg is disabled, the source lines S_g1 and S_g2 are floated.

When the signal Tb is enabled, the signals respectively amplified by the amplifiers 231 and 232 are transmitted to the source lines S_b1 and S_b2 through the second switches 243 and 246, respectively. When the signal Tb is disabled, the source lines S_b1 and S_b2 are floated. The point of time when the gate line Gi is disabled almost corresponds to or slightly goes in advance of the point of time when the signal Tb is disabled.

FIG. 3 is a circuit diagram illustrating parasitic capacitors between adjacent source lines. As illustrated in FIG. 3, coupling capacitors Crg, Cgb and Cbr exist between adjacent source lines S_r1, S_g1, S_b1, S_r2, S_g2 and S_b2. The source lines S_r1 and S_r2 are affected by noise due to video signals applied to the source lines S_g1, S_g2, S_b1 and S_b2 adjacent thereto during a period of time tr for which the source lines S_r1 and S_r2 are floated. The source lines S_g1 and S_g2 are affected by noise due to video signals applied to the source lines S_b1 and S_b2 adjacent thereto during a period of time tg for which the source lines S_g1 and S_g2 are floated.

Due to a difference between the period of time tr during which the source lines S_r1 and S_r2 are floated and the period of time tg during which the source lines S_g1 and S_g2 are floated, the source lines S_r1 and S_r2 and the source lines S_g1 and S_g2 have different noise aspects. That is, the number of times of coupling according to video signals transmitted to source lines adjacent to the source lines S_r1 and S_r2 during the period of time tr when the source lines S_r1 and S_r2 are floated is different from the number of times of coupling according to video signals transmitted to source lines adjacent to the source lines S_g1 and S_g2 during the period of time tg when the source lines S_g1 and S_g2 are floated, resulting in stripes on a screen caused by voltage level distortion.

Furthermore, a difference between charge sharing time of parasitic capacitors Crg, Cgb and Cbr between the source lines S_r1, S_g1, S_b1, S_r2, S_g2 and S_b2 and charge sharing time of capacitors of liquid crystal cells generates a voltage difference between video signals applied to the source lines S_r1, S_g1, S_b1, S_r2, S_g2 and S_b2 and video signals stored in the capacitors. This kick-back noise distorts video signals and varies transmissivity of liquid crystal to cause flicker.

A method of compensating the kick-back noise to remove stripes or flicker can be considered. However, it is difficult to compensate the kick-back noise because the source lines S_r1, S_g1, S_b1, S_r2, S_g2 and Sb2 have different kick-back noise components.

SUMMARY OF THE INVENTION

The present invention is provided to substantially obviate one or more limitations and disadvantages associated with conventional LCD's. Embodiments of the present invention provide a method for driving a liquid crystal display (LCD) device using gray-scale voltages whose dynamic ranges are different from each other depending on pixel color. The gray-scale voltages are output to a source line driver. Embodiments of the invention also provide a gray-scale voltage generation circuit coupled to a LCD source line driver. The disclosed method and circuit reduce coupling phenomena in source lines to substantially remove artifacts such as stripes or flicker in an LCD device.

In some embodiments of the present invention, a method of driving a liquid crystal display (LCD) device includes: receiving display data; generating a plurality of gray-scale voltages based on a pixel color; and outputting a source line driver voltage to the LCD device based on the received display data and at least one of the generated plurality of gray-scale voltages.

In some embodiments of the present invention, a liquid crystal display (LCD) device includes: a gray-scale voltage generation circuit configured to generate a plurality of gray-scale voltages based on a pixel color; and a source driver coupled to the gray-scale voltage generation circuit, the source driver configured to receive display data, the source driver further configured to select one of the plurality of gray-scale voltages based on the display data, the source driver further configured to output a source line voltage to the LCD device based on the selected one of the plurality of gray-scale voltages.

DESCRIPTION OF THE EMBODIMENTS

Figure 1:
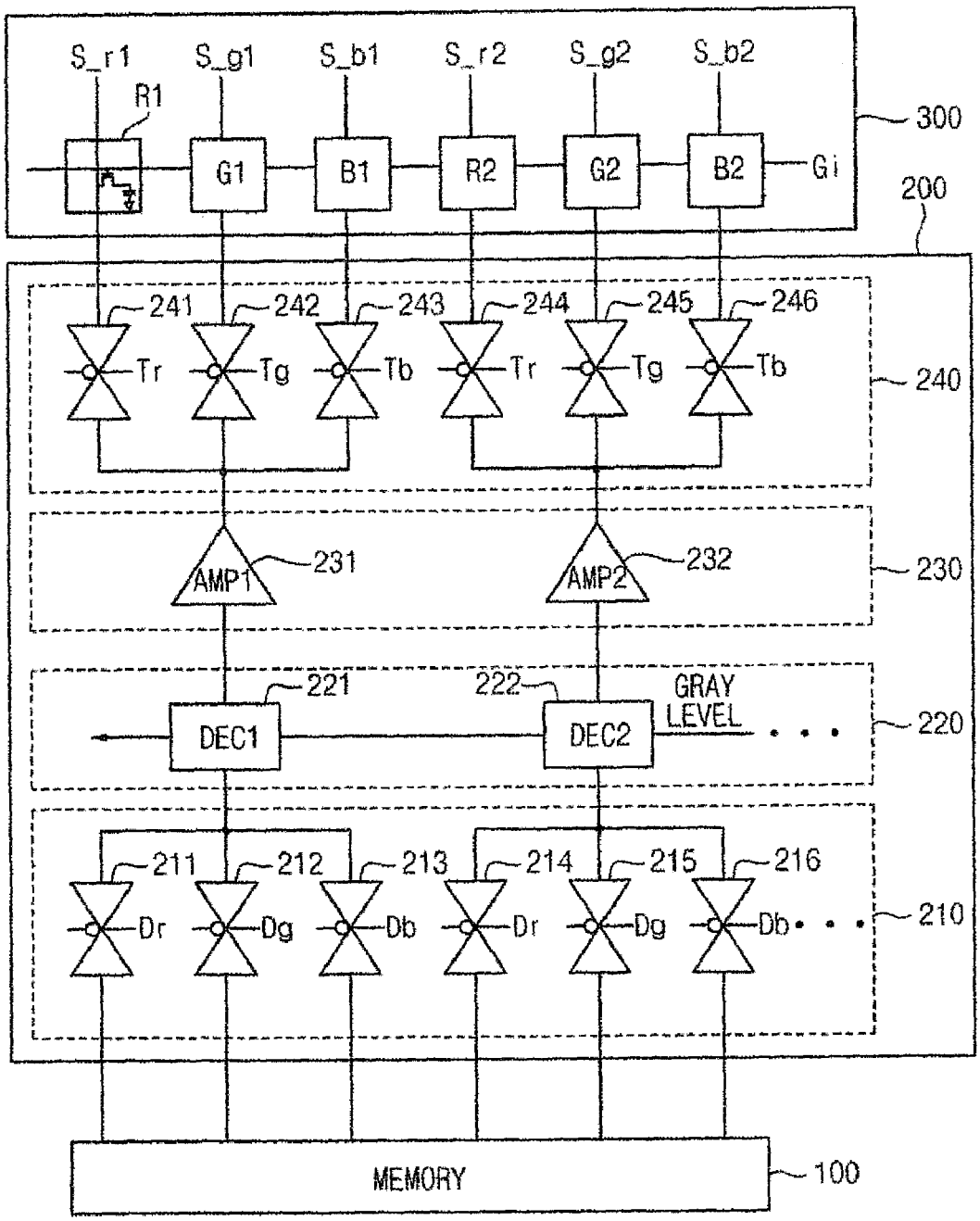
FIG.1 (PRIOR ART)
FIG. 1 is a block diagram illustrating a conventional LCD device having a multi-channel single-amplifier structure.
Figure 2:
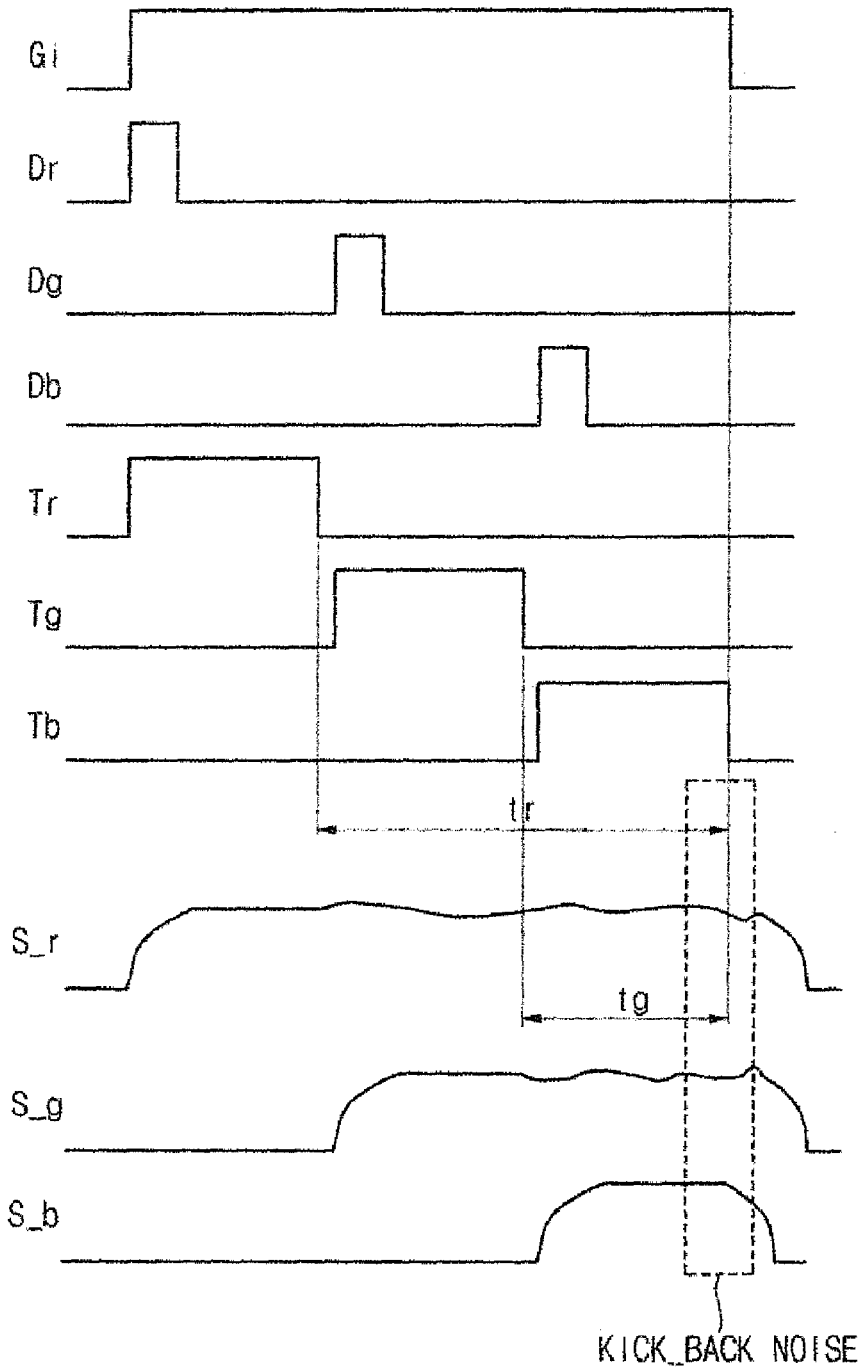
FIG.2 (PRIOR ART)
FIG. 2 is a timing diagram of signals in a source driver having the 3-channel per amplifier structure illustrated in FIG. 1.
Figure 3:
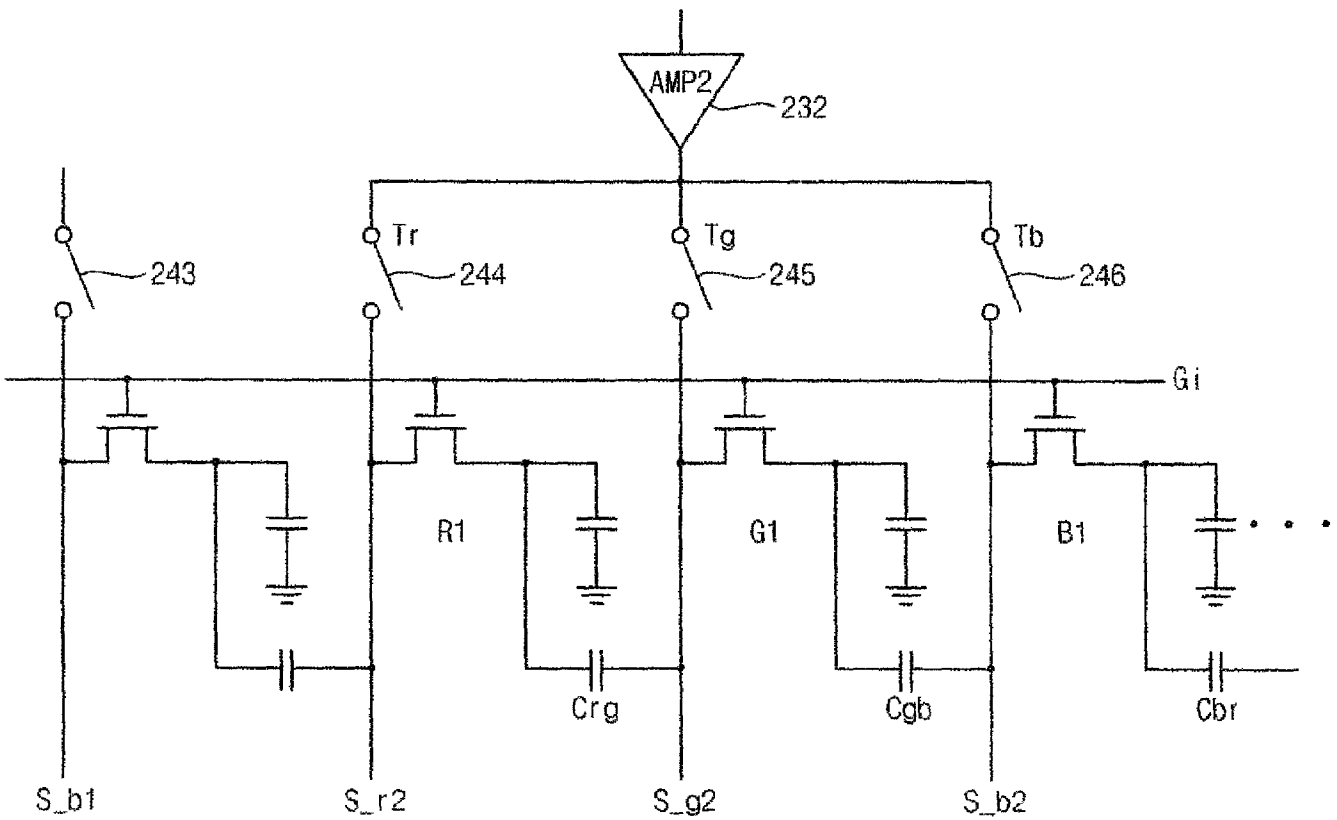
FIG. 3 (PRIOR ART)
FIG. 3 is a circuit diagram illustrating parasitic capacitors between adjacent source lines.

Embodiments of the present invention now will be described more fully with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout this application.

It will be understood that, although the terms first, second, etc. may be used herein to describe various elements, these elements should not be limited by these terms. These terms are used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Figure 4:
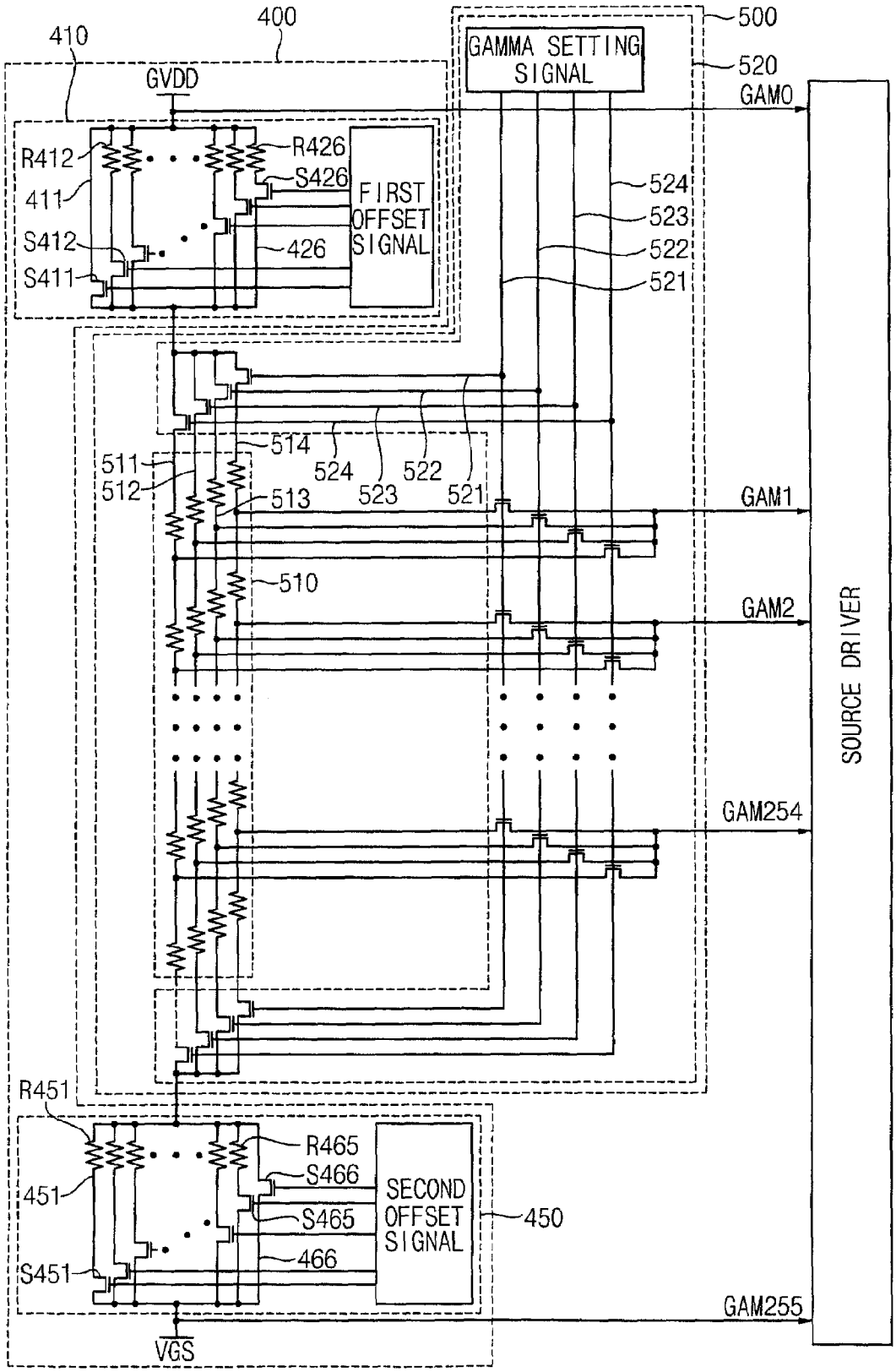
FIG. 4 is a circuit diagram illustrating a gray-scale voltage generation circuit according to some example embodiments of the present invention.

FIG. 4 is a circuit diagram illustrating a gray-scale voltage generation circuit according to some example embodiments of the present invention.

Referring to FIG. 4, the gray-scale voltage generation circuit includes a voltage range determination unit 400 coupled to a voltage division unit 500. The voltage range determination unit 400 includes a first voltage unit 410 and a second voltage unit 450. The voltage division unit 500 includes a resistor array unit 510 and a switch array unit 520.

The voltage range determination unit 400 determines a dynamic range of the gray-scale voltage.

The first voltage unit 410 selects an upper limit of the dynamic range in response to a first offset signal. One end of the first voltage unit 410 is coupled to a gamma power voltage GVDD and the other end of the first voltage unit 410 is coupled to the resistor array unit 510. The first voltage unit 410 includes multiple selecting branches 411 through 426 connected in parallel between the gamma power voltage GVDD and the resistor array unit 510. One selecting branch 411 includes only a switch S411. Each of the other selecting branches 412 through 426 includes one of the corresponding resistors R412 through R426 and one of the corresponding switches S412 through S426 in which one resistor and one switch are connected to each other in series. All of resistances of the resistors R412 through R426 are different from each other. In some embodiments, the resistances of the resistors R412 through R426 may increase monotonically. The switches S411 through S426 may be implemented as n-type MOS transistors. Since only one of the switches S411 through S426 is turned on by the first offset signal, a voltage at a first node N1 varies depending on the switch turned on. For example, if the switch S411 is turned on, the voltage at the first node N1 is the gamma power voltage GVDD. If one of the other switches S412 through S426 is turned on, the voltage at the first node N1 varies depending on the resistance of the corresponding resistor R412 through R426 in the selected branch.

The second voltage unit 450 selects a lower limit of the dynamic range in response to a second offset signal. One end of the second voltage unit 450 is coupled to a ground voltage VGS, and the other end of the second voltage unit 450 is coupled to the resistor array unit 510. The second voltage unit 450 includes a plurality of selecting branches 451 through 466 connected in parallel between the ground voltage VGS and the resistor array unit 510. One selecting branch 466 includes only a switch S466. Each of the other selecting branches 451 through 465 includes a corresponding one of resistors R451 through R465 and a corresponding one of switches S451 through S465 in which one resistor and one switch are connected to each other in series. All resistance values of the resistors R451 through R465 are different from each other. In some embodiments, the resistances of the resistors R451 through R465 may increase monotonically. The switches S451 through S466 may be implemented as n-type MOS transistors. Since only one of the switches S451 through S466 is turned on by the second offset signal, a voltage at a second node N2 varies depending on the switch turned on. For example, if the switch S466 is turned on, the voltage at the second node N2 is the ground voltage VGS. If one of the other resistors S451 through S465 is turned on, the voltage at the second node N2 varies depending on the resistance of the corresponding resistors R451 through R465 in the selected branch. The first offset signal and the second offset signal may be applied to the first voltage unit 410 and the second voltage unit 450 sequentially or simultaneously.

The voltage division unit 500 includes the resistor array unit 510 coupled to the switch array unit 520.

The resistor array unit 510 includes multiple (for example, four) resistor arrays 511, 512, 513, and 514. The resistor arrays 511, 512, 513, and 514 have the same number of resistors, the resistances of which are different according to the resistor array. For example, in a circuit configured to selectively generate 256 gray-scale voltages, each resistor array has 255 resistors. The resistor arrays 511, 512, 513, and 514 divide a voltage between the first node N1 and the second node N2 by the resistors constituting each of the resistor arrays 511, 512, 513, and 514. That is, the voltage between the first node N1 and the second node N2 is divided into 254 voltages. The divided voltages have different magnitudes depending on the respective resistor arrays.

The switch array unit 520 includes multiple (for example, four) switch arrays 521, 522, 523, and 524. Each of the switch arrays 521, 522, 523, and 524 include a number of switches that exceeds the number of resistors in a single resistor array by one. For example, where each resistor array 511, 512, 513, and 514 include 255 resistors, then there may be 256 switches in each of the switch arrays 521, 522, 523, and 524. The switch array unit 520 outputs the gray-scale voltages GAM1 through GAM255 divided by the resistor array unit 510 to a source line driver in response to the gamma setting signal. Even when the voltage between the first node N1 and the second node N2 is held constant, the gray-scale voltages GAM1 through GAM255 provided to the source line driver may be varied by using the gamma setting signal to select a different switch array.

Variations to the circuit illustrated in FIG. 4 are possible. For instance, in an alternative embodiment, one or both of the voltage units 410 and 450 may be deleted. Moreover, the quantity of resistor arrays in the resistor array unit 510, and the quantity of resistors in each of the resistor arrays, may be changed according to design choice.

Figure 5:
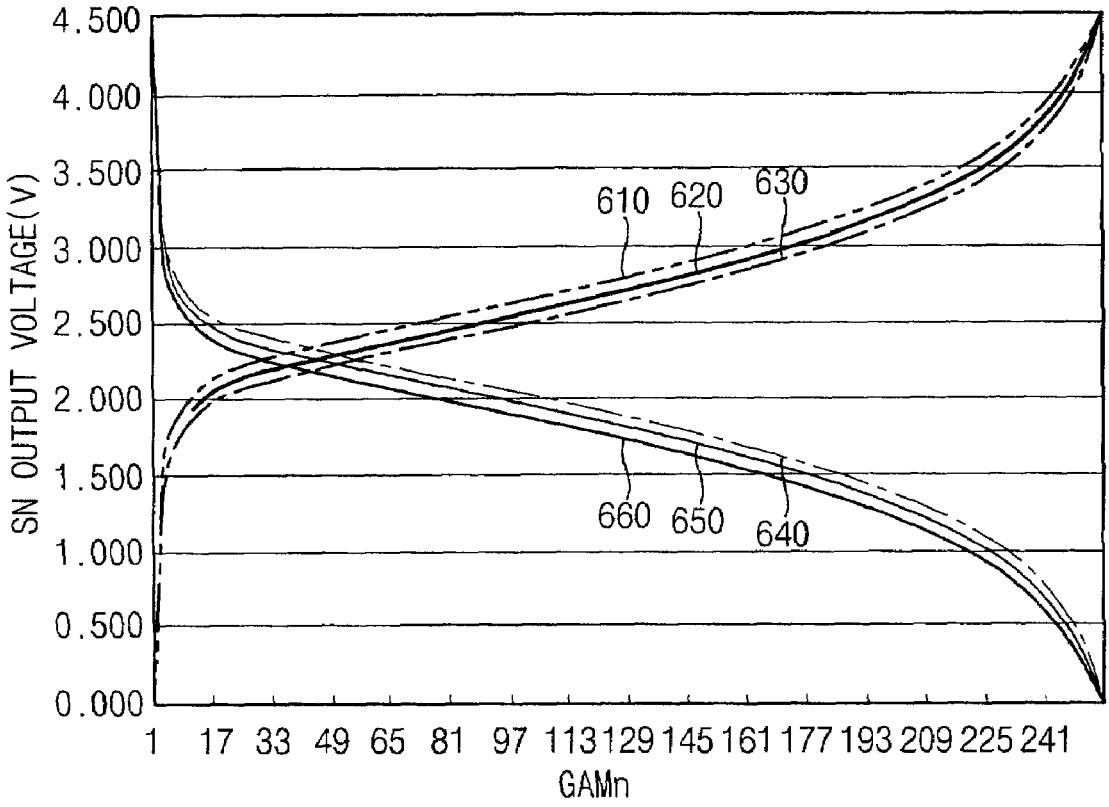
FIG. 5 is a graph illustrating gray-scale voltages that are generated by the circuit of FIG. 4 according to some example embodiments of the present invention.

FIG. 5 is a graph illustrating the magnitude of gray-scale voltages GAMn that are generated by the circuit of FIG. 4. Each of the gamma curves 610, 620, 630, 640, 650, and 660 describe the relationship between pixel color intensity and gray-scale level. Gamma curves 610, 620, and 630 are increasing gamma curves, and gamma curves 640, 650, and 660 are decreasing gamma curves.

In FIG. 5, it is assumed that the first offset signal and the second offset signal of FIG. 4 are applied simultaneously to the first voltage unit 410 and the second voltage unit 450 of FIG. 4, respectively. That is, it is assumed that the first offset signal is the same as the second offset signal.

Referring to FIG. 5, gamma curves shift in magnitude depending on applied offset signals. For example, increasing gamma curves 610, 620, and 630 are shifted in magnitude with respect to each other in response to the first and second offset signals applied to the voltage range determination unit 400. Because the gray-scale voltages GAMn are output to a source line driver, source driving voltages applied to source lines of an LCD device vary in magnitude according to the offset signals. In embodiments of the invention, different offset signals are associated with different pixel colors, as described below.

Figure 6:
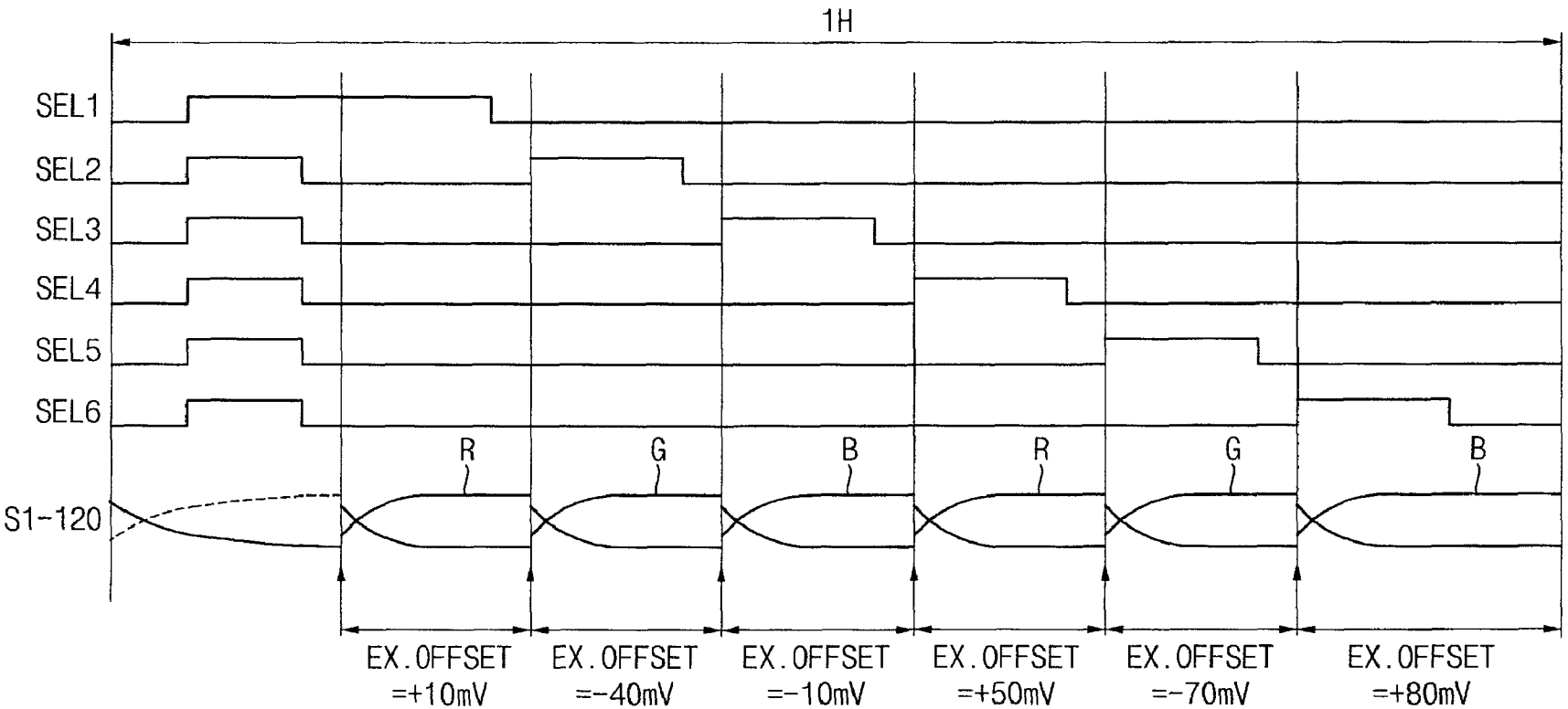
FIG. 6 is a timing diagram for signals in an LCD device having a multi-channel single-amplifier structure according to some example embodiments of the present invention.
Figure 7:
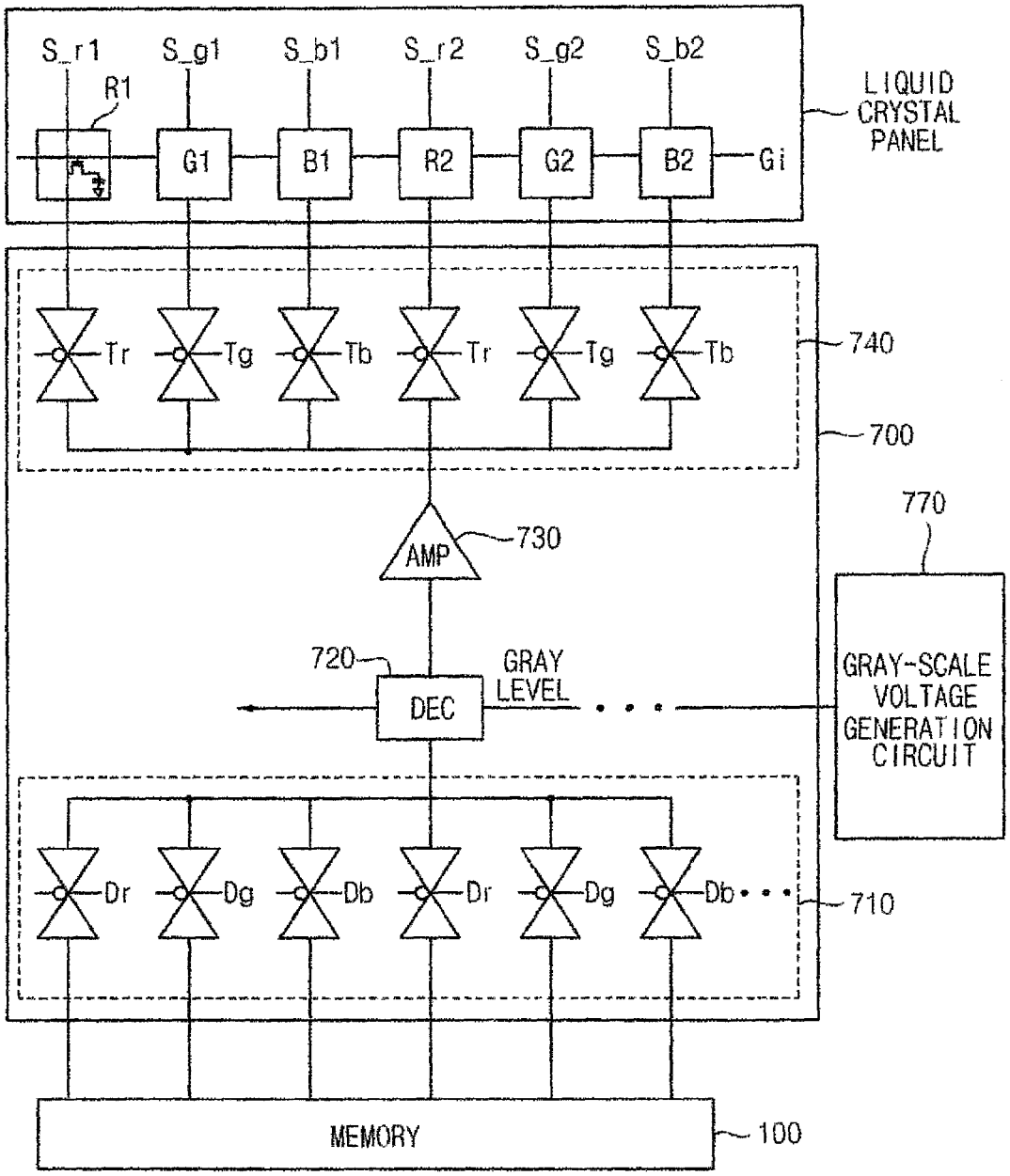
FIG. 7 is a block diagram illustrating an LCD device including a gray-scale voltage generation circuit according to some example embodiments of the present invention.

FIG. 6 is a timing diagram for signals in an LCD device having a multi-channel single-amplifier structure according to some example embodiments of the present invention. FIG. 7 is a block diagram illustrating an LCD device according to some example embodiments of the present invention. FIG. 6 and FIG. 7 illustrate a six-channel single-amplifier structure having 120 source lines.

FIG. 6 illustrates the relationship between offset signals (EX. OFFSET), selecting branch signals (SEL 1 through SEL 6), source line voltages (S1-120), and pixel colors R (red), G (green), and B (blue). Each of the offset signals (EX. OFFSET) may be, for example, the first offset signal and the second offset signal that are simultaneously input (at the same magnitude) to the voltage range determination unit 400. Each of the selecting branch signals (SEL 1 through SEL 6) may be control signals used to select a selecting branch in the first voltage unit and a selecting branch in the second voltage unit of the voltage range determination unit 400. The source line voltages S1-120 may be associated with gray scale voltages GAMn and may further represent voltages on source lines S_r1, S_g1, S_b1, etc. of an LCD panel.

In operation, a LCD panel may be reset to black or white by simultaneously enabling all offset signals. If an offset signal of 10 mV is applied, a selecting branch 411 and a selecting branch 466 may be selected, and thus gray-scale voltages associated with gamma curve 610 of FIG. 5 can be applied to source driver 700 to output a voltage on source line S_r1 of FIG. 7. If an offset signal of −40 mV is applied, a selecting branch 412 and a selecting branch 465 may be selected, and thus gray-scale voltages associated with gamma curve 620 of FIG. 5 can be applied to a source driver 700 to output a voltage on source line S_g1 of FIG. 7. If an offset signal of −70 mV is applied, a selecting branch 426 and a selecting branch 451 may be selected, and thus gray-scale voltages associated with gamma curve 630 of FIG. 5 can be applied to a source driver 700 to output a voltage on source line S_b1 of FIG. 7. The other offset signals are similarly used to select the other gamma curves. Decreasing gamma curves 640, 650, and 660 of FIG. 6 may be obtained by interchanging positions of the gamma power voltage and the ground voltage in the circuit illustrated in FIG. 4. As described above, because gray-scale voltages associated with each source line are different depending on the applied first and second offset signals, the effects of signal coupling may be reduced.

FIG. 7 is a block diagram illustrating an LCD device including a gray-scale voltage generation circuit according to some example embodiments of the present invention. The gray-scale voltage generation circuit is configured to selectively generate gray-scale voltages whose dynamic ranges vary according to their associated pixel colors Referring to FIG. 7, the LCD device includes a gray-scale voltage generation circuit 770 having a multi-channel single-amplifier structure.

The gray-scale voltage generation circuit 770 may be, for example, the gray-scale voltage generation circuit illustrated in FIG. 4 that includes a voltage range determination unit 400 and a voltage division unit 500. The voltage range determination unit 400 includes a first voltage unit 410 and a second voltage unit 450. The voltage division unit 500 includes a resistor array unit 510 and a switch array unit 520.

A source line driver 700 of FIG. 7 includes a multiplexer 710, a decoder 720, an amplifier 730, and a demultiplexer 740 coupled in series. In contrast to the source line driver 200 of FIG. 1, the source line driver 700 of FIG. 7 may be implemented as a six-channel single-amplifier structure with a single decoder 720 and a single amplifier 730. In an alternative embodiment, the source line driver 700 may also be implemented as a source line driver having a nine-channel single-amplifier structure.

In operation, the multiplexer 710 receives display data from the memory, multiplexes the display data in response to first control signals Dr, Dg and Db, and outputs the multiplexed display data to the decoder 720. The gray-scale voltage generation circuit 770 generates gray-scale voltages with varying dynamic range in response to offset signals. The generated gray-scale voltages have varying dynamic range, and each different range is associated with a display color. The decoder 720 outputs decoded data to the amplifier 730 based on the multiplexed display data and the gray-scale voltages. The amplifier 730 amplifies the decoded data, and the demultiplexer 740 applies the output of the amplifier 730 to source lines S_r1, S_g1, S_b1, S_r2, S_g2, and S_b2 of the LCD panel based on second control signals Tr, Tg, and Tb. The gray-scale voltage generation circuit 770 and the decoder 720 are configured such that gray-scale voltages associated with a first display color are offset in magnitude with respect to gray-scale voltages associated with a second display color.

Figure 8:
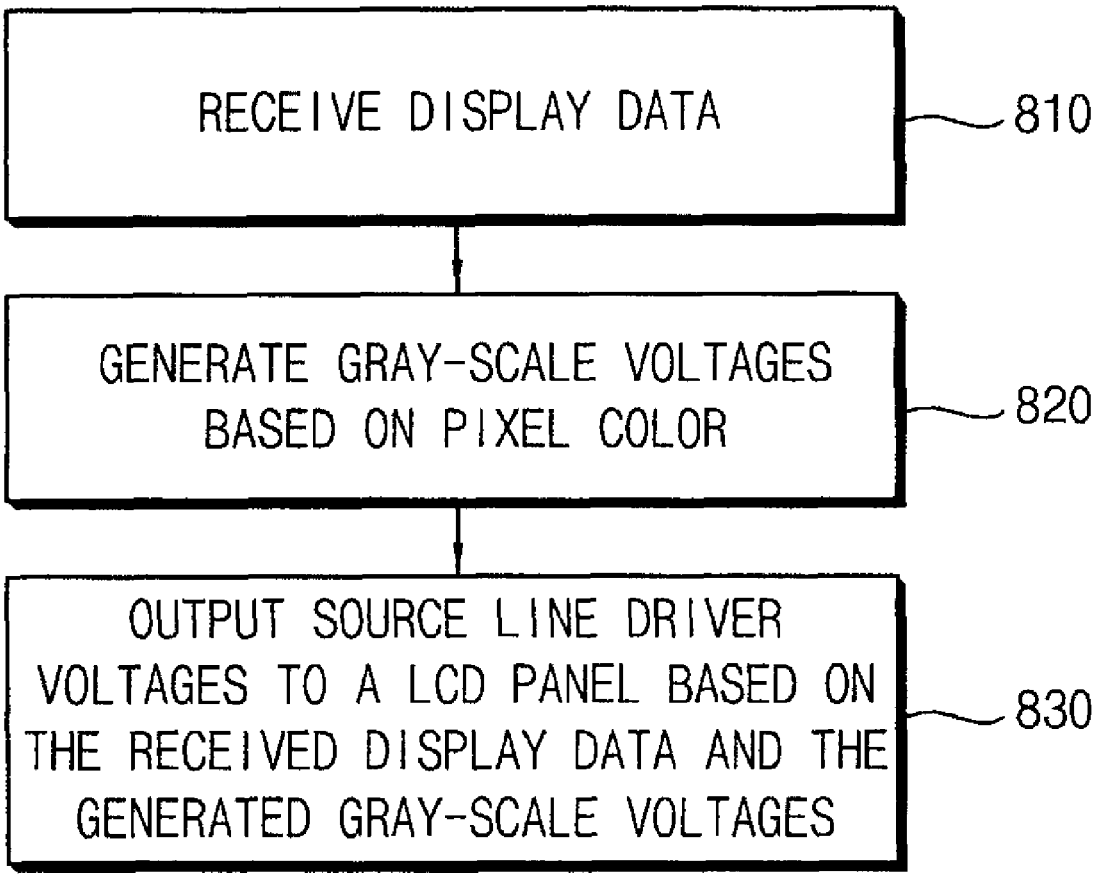
FIG. 8 is a flow diagram of a method for driving a LCD panel, according to an embodiment of the invention.

FIG. 8 is a flow diagram of a method for driving a LCD panel, according to an embodiment of the invention. In step 810, the process receives display data, for example from a memory device. The display data may include, among other things, an assigned gray-scale (brightness) level for each color of each pixel on the LCD panel. Next, in step 820, the process generates gray-scale voltages based on pixel color. Finally, in step 830, the process outputs source line driver voltages to a LCD panel based on the received display data and the generated gray-scale voltages.

In embodiments of the invention, step 810 includes multiplexing the display data. Step 820 can include determining a voltage range based on a pixel color, and dividing the voltage range to generate the gray-scale voltages within the range. Moreover, step 830 can include decoding the multiplexed display data, amplifying the decoded data, and demultiplexing the amplified data.

While the example embodiments of the present invention and their advantages have been described in detail, it should be understood that various changes, substitutions and alterations may be made herein without departing from the scope of the invention.

What is claimed is:

1. A liquid crystal display (LCD) device, comprising:

a liquid crystal panel comprising a plurality of pixels respectively driven by one of the N source line channels; and a source line driver, comprising:

a memory storing display data;

a multiplexer configured to receive display data from the memory and generate multiplexed display data;

a gray-scale voltage generation circuit configured to generate a plurality of gray-scale voltages, wherein each one of the plurality of gray-scale voltages is generated on the basis of one display color selected from a plurality of display colors;

only a single decoder configured to generate decoded data from the multiplexed display data and the plurality of gray-scale voltages;

only a single amplifier configured to receive and amplify the decoded data to output amplified decoded data; and a demultiplexer configured to demultiplex the amplified decoded data to generate demultiplexed amplified decoded data and provide the demultiplexed amplified decoded data via N source line channels, wherein the gray-scale voltage generation circuit and decoder are configured such that a first set of gray-scale voltages associated with a first display color selected from the plurality of display colors is offset in magnitude with respect to a second set of gray-scale voltages associated with a second display color selected from the plurality of display colors.

2. The LCD device of claim 1 wherein the gray-scale voltage generation circuit comprises:

a voltage range determination unit configured to determine a dynamic range for the plurality of gray-scale voltages in response to at least one offset signal selected from a plurality of offset signals, wherein each one of the plurality of offset signals corresponding to one of the plurality of display colors, and generate a voltage within the dynamic range of the plurality of gray-scale voltages in response to the at least one offset signal; and a voltage division unit coupled to the voltage range determination unit and configured to divide the voltage into one of the plurality of gray-scale voltages.

3. The LCD device of claim 2, wherein the voltage range determination unit comprises:

a first voltage unit coupled to a first end the voltage division unit and configured to select an upper limit of the dynamic range in response to a first offset signal; and a second voltage unit coupled to a second end of the voltage division unit opposite the first end and configured to select a lower limit of the dynamic range in response to a second offset signal, wherein the voltage divided by the voltage division unit is defined between the first and second ends.

4. The LCD device of claim 3, wherein the voltage division unit comprises:

a resistor array unit formed between the first voltage unit and the second voltage unit and configured to divide the voltage between the upper limit and the lower limit into the plurality of gray-scale voltages; and a switch array unit coupled to the resistor array unit and configured to output a selected one of the plurality of gray-scale voltages in response to a gamma setting signal.

5. The LCD device of claim 4, wherein the resistor array unit comprises a plurality of resistor arrays, each of the plurality of resistor arrays including a plurality of serially-connected resistors, each of the plurality of resistor arrays having a unique set of resistance values.

6. The LCD device of claim 4, wherein the switch array unit comprises a plurality of switch arrays, each of the plurality of switch arrays having a plurality of serially-connected switches, a first switch of the plurality of serially-connected switches configured to connect the first voltage unit to a corresponding resistor array, a second switch of the plurality of serially-connected switches configured to connect the second voltage unit to the corresponding resistor array.

7. The LCD device of claim 6, wherein the switch array unit is configured such that the plurality of serially-connected switches in a selected one of the plurality of switch arrays are configured to be simultaneously activated in response to the gamma setting signal.

8. The LCD device of claim 4, wherein the first voltage unit includes a plurality of selecting branches connected in parallel between a gamma power voltage and the resistor array unit.

9. The LCD device of claim 8, wherein one selecting branch of the plurality of selecting branches includes only a switch.

10. The LCD device of claim 9, wherein each of the other selecting branches of the plurality of selecting branches include a resistor and a switch connected in series.

11. The LCD device of claim 10, wherein each of the other selecting branches has a unique resistance value with respect to the other selecting branches.

12. The LCD device of claim 11, wherein the each switch of the plurality of selecting branches is configured to receive the first offset signal.

13. The LCD device of claim 12, wherein the each switch of the plurality of selecting branches is an n-type MOS transistor.

14. The LCD device of claim 4, wherein the second voltage unit includes a plurality of selecting branches connected in parallel between a ground voltage and the resistor array unit.

15. The LCD device of claim 14, wherein one selecting branch of the plurality of selecting branches includes only a switch.

16. A method of driving a liquid crystal display (LCD) device, comprising:

receiving display data in a multiplexer and generating multiplexed display data;

generating a plurality of gray-scale voltages, wherein each one of the plurality of gray-scale voltages is generated on the basis of one display color selected from a plurality of display colors;

receiving the multiplexed data and the plurality of gray-scale voltages in only a single decoder and generating decoded data;

receiving and amplifying the decoded data in only a single amplifier and generating amplified decoded data; and receiving the amplified decoded data in a demultiplexer, generating demultiplexed amplified decoded data, and providing the demultiplexed amplified decoded data via N source line channels; and respectively driving each one of a plurality of pixels in a liquid crystal display using one of the N source line channels, wherein generation of the plurality of gray-scale voltages comprises generating a first set of gray-scale voltages associated with a first display color selected from the plurality of display colors, and generating a second set of gray-scale voltages associated with a second display color selected from the plurality of display colors, wherein the first set of gray-scale voltages is offset in magnitude with respect to a second set of gray-scale voltages.

* * * * *